US006155788A

United States Patent [19]

Beckford et al.

[11] Patent Number: 6,155,788

[45] Date of Patent: Dec. 5, 2000

[54] ROTOR ASSEMBLY

[75] Inventors: Peter R Beckford, Derby; David R Midgelow, Nottingham; David S Knott, Loughborough, all of United Kingdom

[73] Assignee: Rolls-Royce PLC, London, United Kingdom

[21] Appl. No.: 09/334,940

[22] Filed: Jun. 17, 1999

[30] Foreign Application Priority Data

Jul. 7, 1998 [GB] United Kingdom ..... 9814567

[51] Int. Cl.[7] ..... F01D 5/30

[52] U.S. Cl. ..... 416/219 R; 416/193 A; 416/201 R; 416/248

[58] Field of Search ..... 416/193 A, 198 A, 416/200 A, 201 R, 202, 219 R, 220 R, 248

[56] References Cited

U.S. PATENT DOCUMENTS

| | | | |
|---|---|---|---|
| 2,639,119 | 5/1953 | Greenwald | 416/217 |
| 2,751,189 | 6/1956 | Ledwith . | |
| 3,378,230 | 4/1968 | Toomey . | |
| 5,340,280 | 8/1994 | Schilling | 416/229 A |
| 5,913,660 | 6/1999 | Knott | 416/220 R |
| 5,919,032 | 7/1999 | Naudet et al. | 416/216 |

FOREIGN PATENT DOCUMENTS

| | | |
|---|---|---|
| 0521614 A2 | 6/1992 | European Pat. Off. . |
| 0821133 A1 | 6/1997 | European Pat. Off. . |
| 1523422 | 3/1977 | United Kingdom . |
| 2186639 | 2/1986 | United Kingdom . |
| 2287993 | 3/1994 | United Kingdom . |
| 2299834 | 4/1995 | United Kingdom . |

*Primary Examiner*—Edward K. Look
*Assistant Examiner*—Liam McDowell
*Attorney, Agent, or Firm*—Oliff & Berridge, PLC

[57] ABSTRACT

A fan rotor assembly (30) for a gas turbine engine (10) comprises a fan rotor (32) and a plurality of radially extending fan blades (34). Each fan blade (34) has a root (64) which is retained in a corresponding groove (54) in the periphery of the hub (54) of the fan rotor (32). Each fan blade root (64) comprises four axially spaced root portions (66, 68, 70 and 72) which locate in a corresponding number of axially spaced groove portions (56, 58, 60 and 62). The flanks (94, 98) of two of the root portions (66, 70) are arranged at an angle to the axis of the fan rotor (32) and the flanks (96, 100) of the other two root portions (68, 72) are arranged at an angle in the opposite sense. The flanks (74, 76, 78 and 80) of the groove portions (56, 58, 60 and 62) are arranged at the same angle as the flanks (94, 96, 98 and 100) of the corresponding root portions (66, 68, 70 and 72). The arrangement provides improved retention of the fan blades (34) and reduces the weight of the fan blades (34) and fan rotor (32).

35 Claims, 11 Drawing Sheets

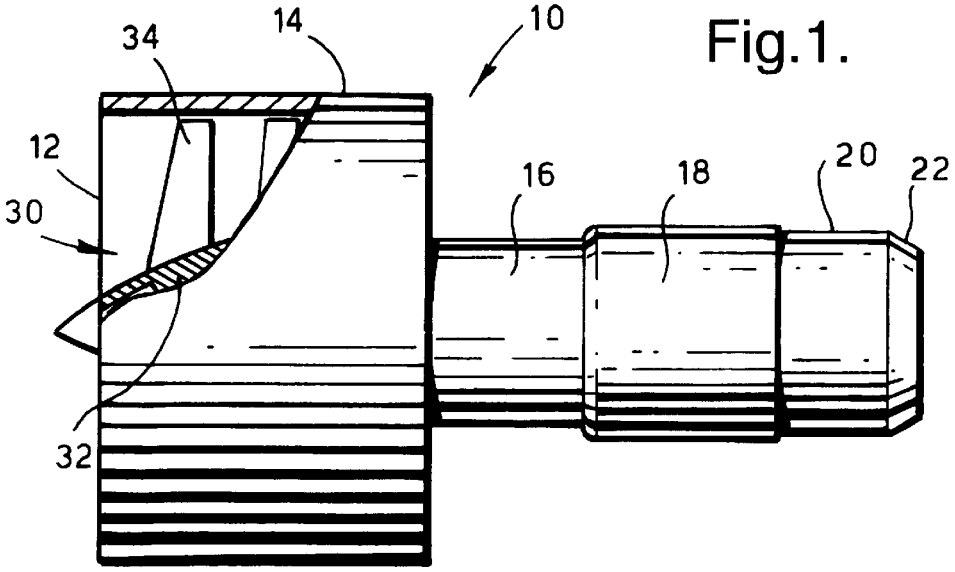
Fig.1.
Fig.4.
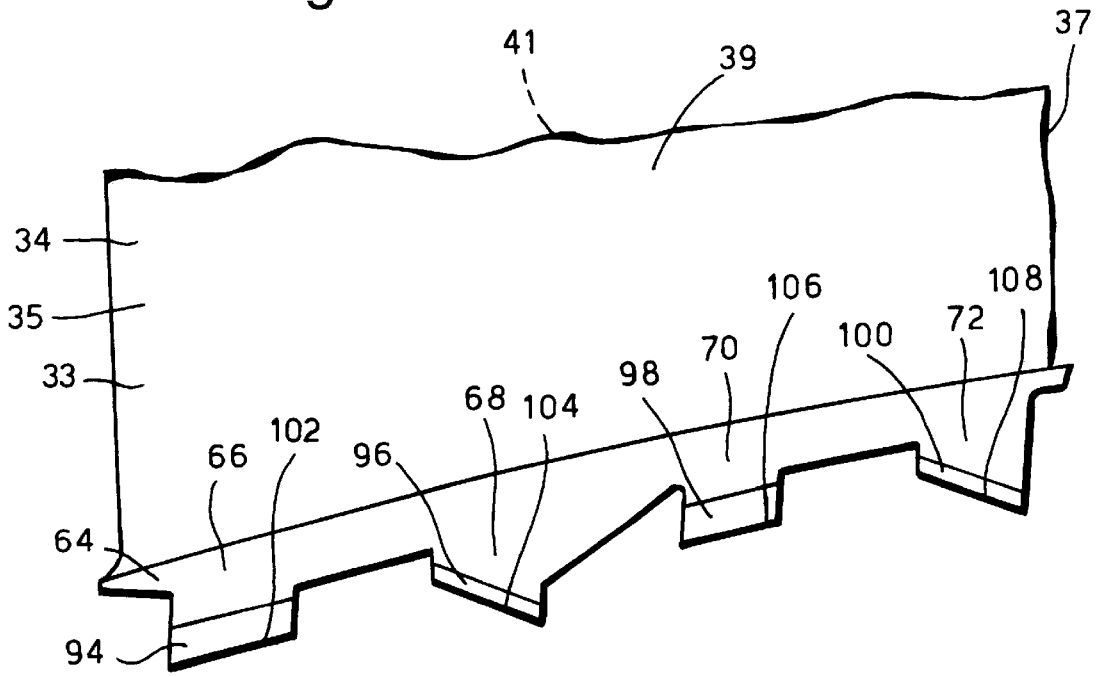

ROTOR ASSEMBLY

The present invention relates generally to a rotor assembly, particularly to a rotor assembly for a gas turbine engine, more particularly to a fan rotor assembly for a turbofan gas turbine engine.

Turbofan gas turbine engines comprise a fan rotor assembly, positioned at the upstream end of a core gas generator, which provides thrust and supplies air to the core gas generator of the turbofan gas turbine engine. Conventionally the fan rotor assembly comprises a rotor hub and a plurality of circumferentially spaced radially extending fan blades. The rotor hub has a plurality of generally axially extending grooves in its periphery and the roots of the fan blades locate and are retained in the grooves. Generally the axially extending grooves have a dovetail cross-section and each of the fan blades has a correspondingly shaped dovetail cross-section root.

Conventionally the base of each axially extending groove is arranged in a plane parallel with the axis of the turbofan gas turbine engine and the base of each fan blade root is also arranged in a plane parallel with the axis of the turbofan gas turbine engine.

It is also known to arrange the base of each axially extending groove at an incline to the axis of the turbofan gas turbine engine and the base of each fan blade root is also arranged at an incline to the axis of the turbofan gas turbine engine.

Generally each fan blade has a single root which locates in a single corresponding axial groove in the periphery of the fan rotor assembly.

It is also necessary to ensure that each fan blade is prevented from axial movement within the corresponding groove on the fan rotor assembly. It is necessary to provide a retention ring as described in UK patent GB1523422 or individual shear lugs as described in published UK patent application GB2287993A.

These arrangements are not satisfactory because additional parts are required to axially retain the fan rotor blades, thus adding to the overall expense and weight of the engine. If the base of the root of the fan blade is arranged in a plane parallel to the axis of the turbofan gas turbine engine there is parasitic mass in the fan blade root. If the base of the root of the fan blade is arranged at an incline to the axis of the turbofan gas turbine engine the parasitic mass in the fan blade root is reduced but additional retention is required to prevent axial movement of the fan blade.

It is known from U.S. Pat. No. 2,751,189 to provide each rotor blade with a plurality of axially spaced root portions which locate in a plurality of axially spaced groove portions on the periphery of a single rotor disc. The base of each groove is arranged in a plane parallel to the axis of the gas turbine engine.

It is also known from published European patent application EP0821133A1, published Jan. 28, 1998, to provide each fan blade with two axially spaced root portions which locate in two axially spaced groove portions on the periphery of a single fan disc. The base portions of the two axially spaced root portions are inclined to the axis of the gas turbine engine but with opposite inclines so that they are radially convergent with respect to the axis of the gas turbine engine. The base portions of the two axially extending grooves are also convergent with respect to the axis of the gas turbine engine.

Accordingly the present invention seeks to provide a novel rotor assembly for a gas turbine engine which provides improved retention of the rotor blades on the rotor.

Accordingly the present invention provides a rotor assembly comprising a rotor having a hub and a plurality of circumferentially spaced radially extending rotor blades, the hub having a plurality of circumferentially spaced axially extending grooves in its periphery, each groove being arranged to receive the root of a corresponding one of the rotor blades, each groove having at least three axially spaced groove portions, each rotor blade having a corresponding number of axially spaced root portions, each groove portion being arranged to receive a corresponding root portion of the corresponding one of the rotor blades, each groove portion having at least two circumferentially extending flanks, each root portion having at least two circumferentially extending flanks, at least the flanks of two of the root portions of each rotor blade being inclined to the axis of the rotor in one sense, at least the flanks of one of the root portions of each rotor blade being inclined to the axis of the rotor in the opposite sense, at least the flanks of two of the groove portions of each groove being inclined to the axis of the rotor in one sense and at least the flanks of one of the groove portions of each groove being inclined to the axis of the rotor in the opposite sense.

Preferably the radius of the hub being smaller at a first axial end of the rotor than at a second axial end of the rotor such that the radii of the bases of the groove portions progressively increase from the first axial end of the rotor to the second axial end of the rotor.

Preferably the bases of the groove portions being inclined to the axis of the rotor such that the radius of the base of each groove portion increases from the first axial end of the groove portion to the second axial end of the groove portion, at least two of the bases of the root portions of each rotor blade being inclined to the axis of the rotor in one sense, at least one of the bases of the root portions of each rotor blade being inclined to the axis of the rotor in the opposite sense.

Preferably each groove has an even number of axially spaced groove portions, each rotor blade has a corresponding number of axially spaced root portions.

Preferably each groove has four axially spaced groove portions, each rotor blade has four axially spaced root portions.

Preferably all the groove portions have equal lengths, half of the number of groove portions are inclined at the same angle in one sense to the axis of the rotor and half of the number of groove portions are inclined at the same angle but in the opposite sense.

Preferably all the groove portions are inclined at an angle between 15° and 18°. Preferably all the groove portions are inclined at an angle of 16.4°.

Alternatively the groove portions have different lengths, half of the number of groove portions are inclined at different angles in one sense to the axis of the rotor and half of the number of groove portions are inclined at different angles but in the opposite sense.

Preferably each of the axially extending groove portions has a dovetail cross-section and each of the rotor portions has a correspondingly shaped dovetail cross-section.

Preferably the rotor comprises a plurality of axially spaced discs, the hub of each disc having one of the root portions.

Preferably the hubs of adjacent discs are interconnected. Preferably the hubs of adjacent discs are interconnected by a welded joint.

Alternatively the rotor may comprise a plurality of axially spaced discs, the hub of each disc having at least two of the root portions.

Preferably the rotor is a fan rotor and the blades are fan blades.

Preferably the rotor is a gas turbine rotor and the blades are gas turbine blades.

The present invention also provides a rotor blade comprising an aerofoil and a root, the aerofoil having a leading edge, a trailing edge, a convex surface and a concave surface, the leading edge and trailing edge extending in a first direction longitudinally of the rotor blade, the root having at least three root portions spaced apart in a second direction extending between the leading edge and the trailing edge of the aerofoil, each root portion having at least two flanks extending transversely to the first direction and transversely to the second direction, at least the flanks of two of the root portions being inclined to the second direction in one sense, at least the flanks of one of the root portions being inclined to the second direction in the opposite sense.

The present invention also provides a rotor having a hub, the hub having a plurality of circumferentially spaced axially extending grooves in its periphery, each groove having at least three axially spaced groove portions, each groove portion having at least two circumferentially extending flanks, at least the flanks of two of the groove portions of each groove being inclined to the axis of the rotor in one sense and at least the flanks of one of the groove portions of each groove being inclined to the axis of the rotor in the opposite sense.

Preferably the radius of the hub being smaller at a first axial end of the rotor than at a second axial end of the rotor such that the radii of the bases of the groove portions progressively increase from the first axial end of the rotor to the second axial end of the rotor.

The present invention will be more fully described by way of example with reference to the accompanying drawing, in which:

FIG. 1 is a view of a turbofan gas turbine engine having a rotor assembly according to the present invention.

FIG. 4 is a cross-sectional view through the root of a rotor blade shown in FIG. 2.

Figure 2:
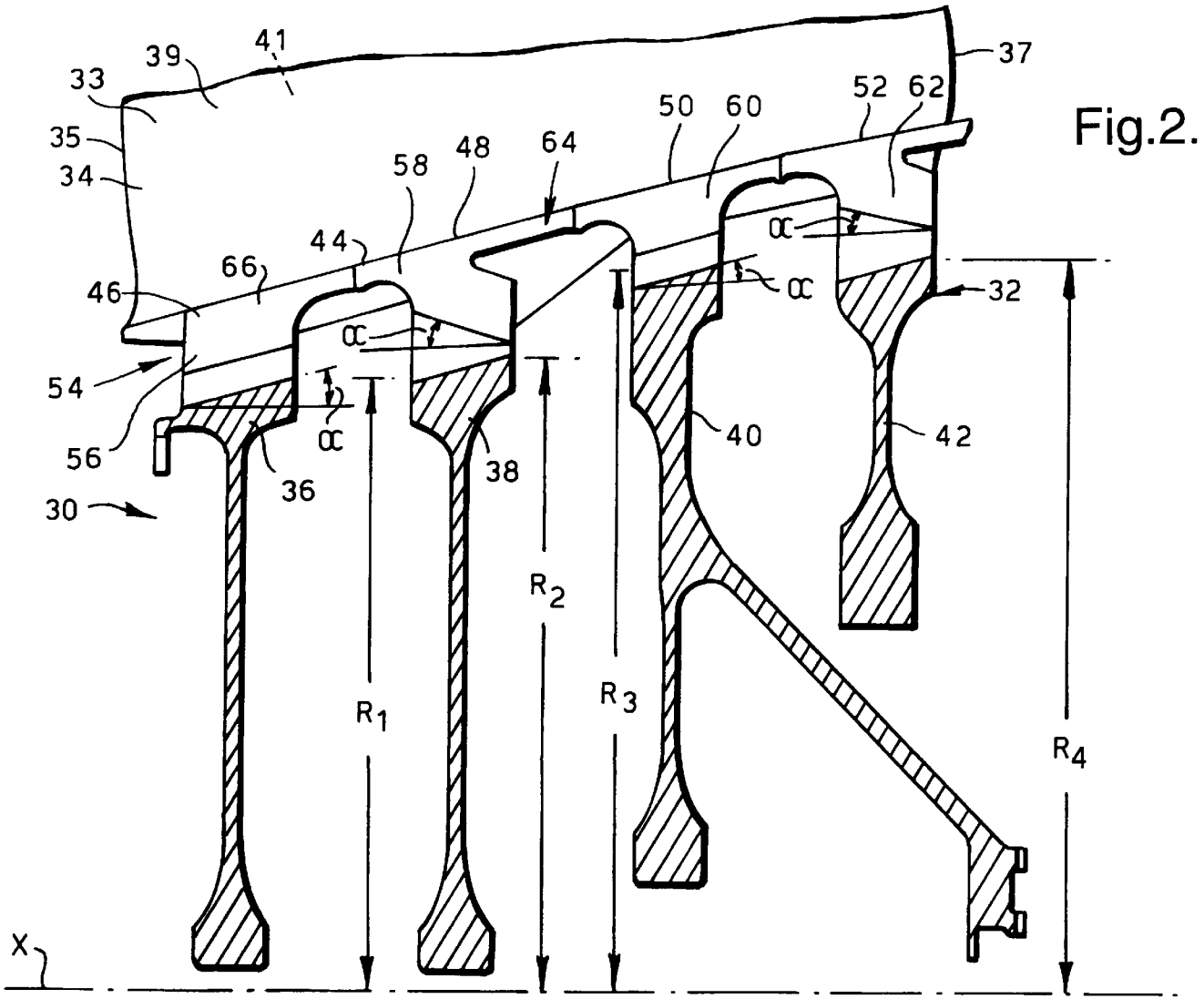
FIG. 2 is an enlarged longitudinal cross-sectional view through the rotor assembly shown in FIG. 1, showing the rotor and the root of a rotor blade.

A turbofan gas turbine engine 10, shown in FIG. 1, comprises in axial flow series an inlet 12, a fan section 14, a compressor section 16, a combustion chamber assembly 18, a turbine section 20 and an exhaust 22. The turbine section 20 is arranged to drive the fan section 14 and the compressor section 16 via one or more shafts (not shown). The operation of the turbofan gas turbine engine 10 is quite conventional and will not be discussed further.

Figure 3:
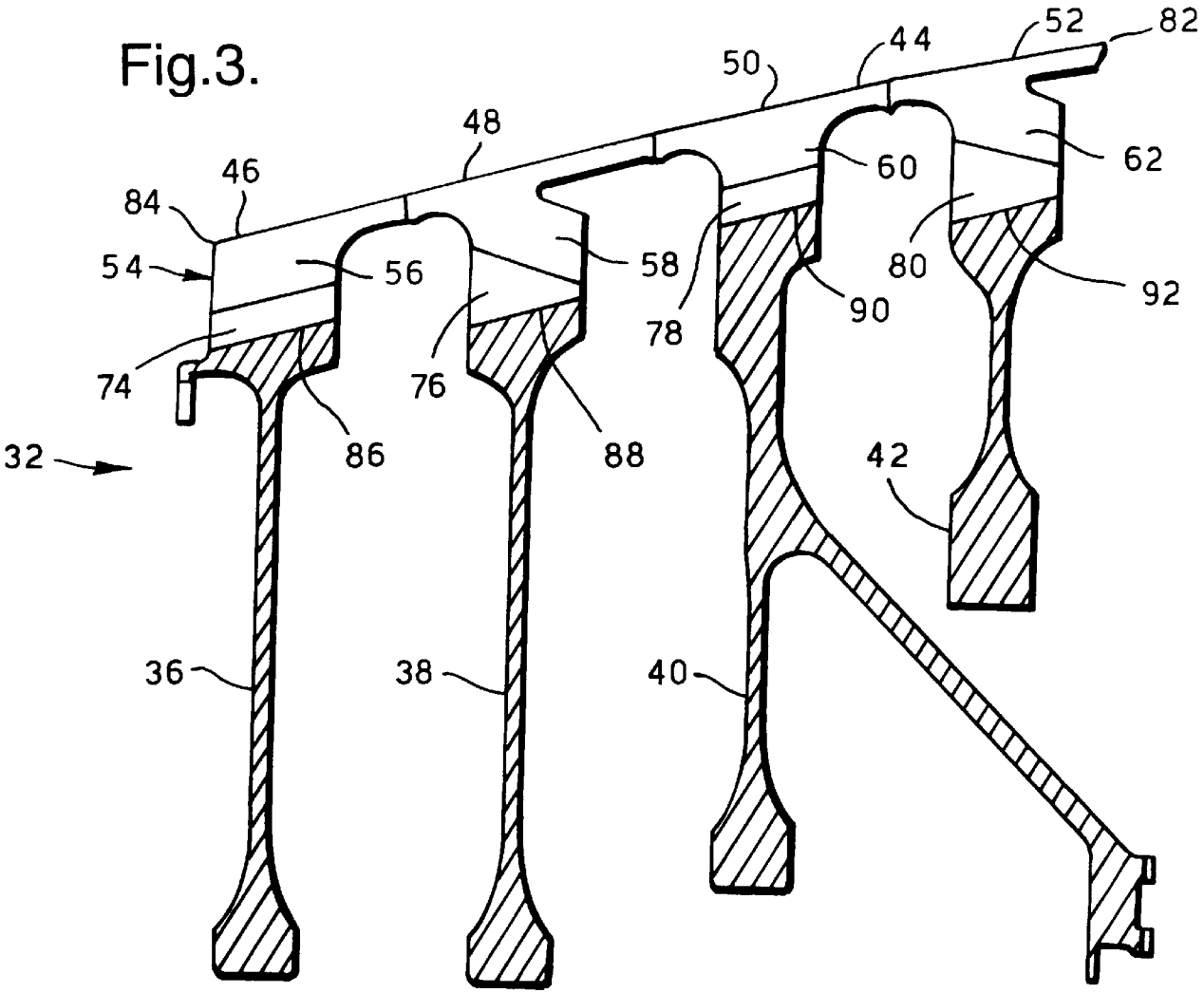
FIG. 3 is a cross-sectional view through the rotor shown in FIG. 2.

The fan section 14, as shown more clearly in FIGS. 2, 3 and 4 comprises a fan rotor assembly 30 which comprises a fan rotor 32 and a plurality of equi-circumferentially spaced radially outwardly extending fan blades 34.

The fan rotor 32 comprises a plurality of axially spaced rotor discs 36, 38, 40 and 42 and adjacent rotor discs 36, 38, 40 and 42 are interconnected to form the fan rotor 32. The fan rotor 32 has a hub 44 defined by the hubs 46, 48, 50 and 52 of the rotor discs 36, 38, 40 and 42 respectively. The adjacent rotor discs 36, 38, 40 and 42 are interconnected, by laser or electron beam welded joints, at the hub 44 to form the fan rotor 32. The hub 44 is provided with a plurality of equi-circumferentially spaced axially extending grooves 54. Each of the axially extending grooves 54 comprises a plurality of axially spaced groove portions 56, 58, 60 and 62. The groove portions 56, 58, 60 and 62 are in the hubs 46, 48, 50 and 52 of the rotor discs 36, 38, 40 and 42 respectively.

Each fan blade 34 comprises an aerofoil 33 and a root 64. Each aerofoil 33 has a leading edge 35, a trailing edge 37, a convex surface 39 and a concave surface 41. The leading edge 35 and the trailing edge 37 of each fan blade 34 extend longitudinally of the fan blade 34. Each root 64 comprises a plurality of axially spaced root portions 66, 68, 70 and 72 equal in number to the number of groove portions 56, 58, 60 and 62. The axial spacing between each of the adjacent root portions 66, 68, 70 and 72 is the same as the corresponding axial spacing between adjacent groove portions 56, 58, 60 and 62. The root portions 66, 68, 70 and 72 are thus spaced apart in the straight line interconnecting the leading edge 35 and the trailing edge 37 of the aerofoil 33, this is more commonly termed the chord line.

Each groove portion 56, 58, 60 and 62 has a dovetail cross-section and therefore each groove portion 56, 58, 60 and 62 has two circumferentially extending flanks 74, 76, 78 and 80 respectively. Each groove portion 56, 58, 60 and 62 has a base 86, 88, 90 and 92 respectively. The flanks 74, 76, 78 and 80 intersect with the bases 86, 88, 90 and 92 to define the dovetail cross-section groove portions 56, 58, 60 and 62.

The flanks 74 and 78 of two of the groove portions 56 and 60 of each groove 54 are inclined to the axis X of the rotor 32 at an angle $\alpha$ in one sense such that the flanks 74 and 78 of groove portions 56 and 60 respectively increase in radius from the first axial, upstream, end of the respective groove portion 56 and 60 to the second axial, downstream, end of the respective groove portion 56 and 60. The flanks 76 and 80 of two of the groove portions 58 and 62 of each groove 54 are inclined to the axis X of the rotor 32 at an angle $\alpha$ in the opposite sense such that the flanks 76 and 80 of groove portions 58 and 62 respectively increase in radius from the second axial, downstream, end of the respective groove portion 58 and 62 to the first axial, upstream, end of the respective groove portion 58 and 62.

The radius of the hub 44 is greater at a second axial, downstream, end 82 of the rotor 32 than at a first axial, upstream, end 84 of the rotor 32 such that the radii R1, R2, R3 and R4 of the bases 86, 88, 90 and 92 of the groove portions 56, 58, 60 and 62 respectively progressively increase from the first axial, upstream, end 81 of the rotor 32 to the second axial, downstream, end 82 of the rotor 32.

The bases 86, 88, 90 and 92 of the groove portions 56, 58, 60 and 62 respectively are inclined to the axis X of the rotor 32 also at an angle α such that the radius of the bases 86, 88, 90 and 92 of each groove portion 56, 58, 60 and 62 respectively increases from the first axial, upstream, end of the respective groove portion 56, 58, 60 and 62 to the second axial, downstream, end of the respective groove portion 56, 58, 60 and 62.

Each root portion 66, 68, 70 and 72 has a dovetail cross-section and therefore each root portion 66, 68, 70 and 72 has two circumferentially extending flanks 94, 96, 98 and 100 respectively. Each root portion 66, 68, 70 and 72 has a base 102, 104, 106 and 108 respectively. The flanks 94, 96, 98 and 100 intersect with the bases 102, 104, 106 and 108 to define the dovetail cross-section root portions 66, 68, 70 and 72.

The flanks 94 and 98 of two of the root portions 66 and 70 of each rotor blade 34 are inclined to the axis X of the rotor 32 at an angle α in one sense such that the flanks 94 and 98 of root portions 66 and 70 respectively increase in radius from the first axial, upstream, end of the respective root portion 66 and 70 to the second axial, downstream, end of the respective root portion 66 and 70. The flanks 96 and 100 of two of the root portions 68 and 70 of each rotor blade 34 are inclined to the axis X of the rotor 32 at an angle α in the opposite sense such that the flanks 96 and 100 of root portions 68 and 72 respectively increase in radius from the second axial, downstream, end of the respective root portion 68 and 72 to the first axial, upstream, end of the respective root portion 68 and 72.

The bases 102 and 106 of two of the root portions 66 and 70 of each rotor blade 34 are inclined to the axis X of the rotor 32 at an angle α in one sense such that the bases 102 and 104 of root portions 66 and 70 respectively increase in radius from the first axial, upstream, end of the respective root portion 66 and 70 to the second axial, downstream, end of the respective root portion 66 and 70. The bases 104 and 108 of two of the root portions 68 and 72 of each rotor blade 34 are inclined to the axis X of the rotor 32 at an angle α in the opposite sense such that the bases 104 and 108 of root portions 68 and 72 respectively increase in radius from the second axial, downstream, end of the respective root portion 68 and 72 to the first axial, upstream, end of the respective root portion 68 and 72.

The axial spacing between the rotor discs 36 and 38 is greater than the axial length of the root portions 68, the axial spacing between the rotor discs 38 and 40 is greater than the axial length of the root portions 70 and the axial spacing between the rotor discs 40 and 42 is greater than the axial length of the root portions 72.

Figure 5:
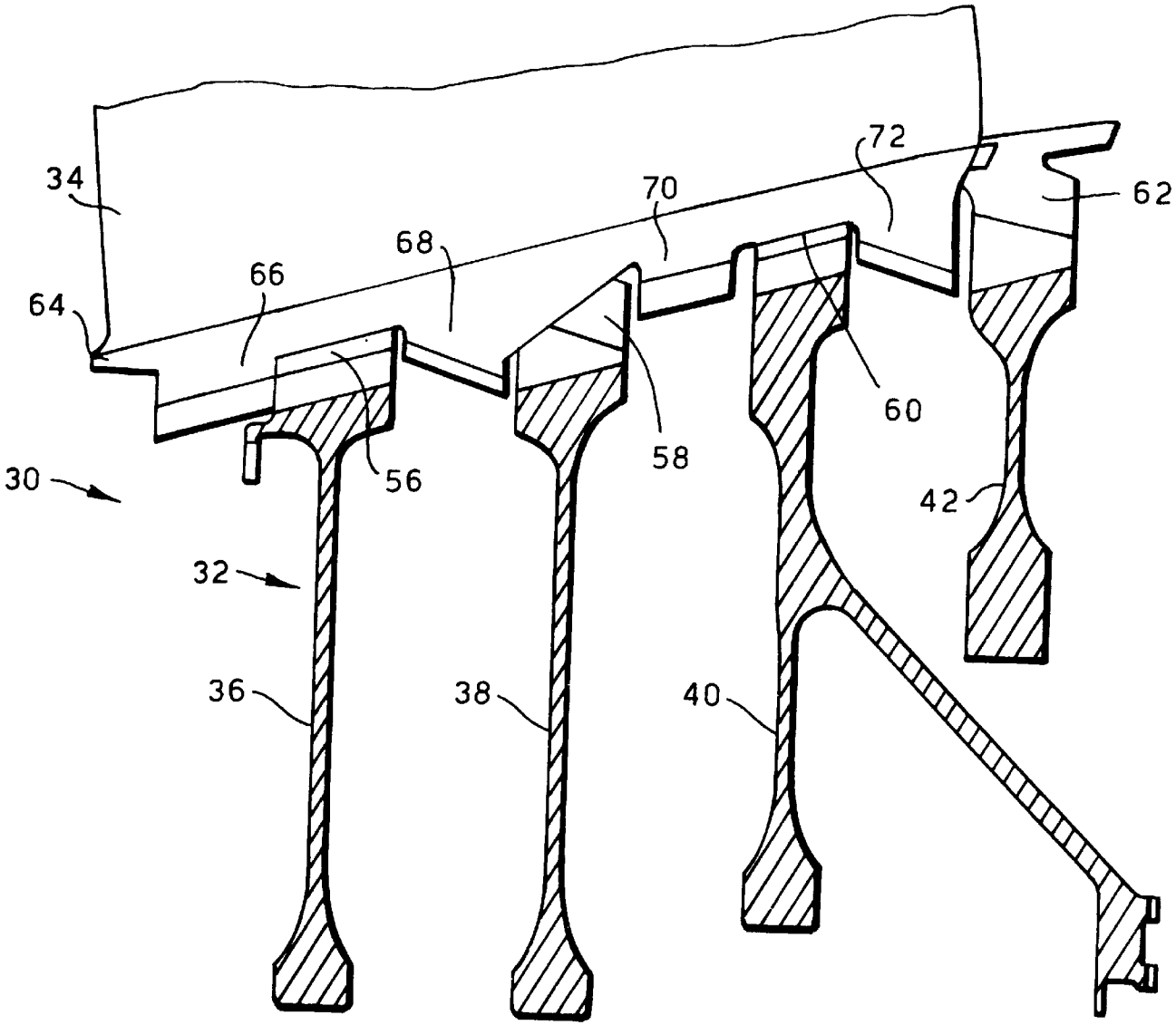
FIG. 5 is a cross-sectional view showing one stage in the installation of a rotor blade in the rotor to form the rotor assembly shown in FIG. 2.
Figure 6:
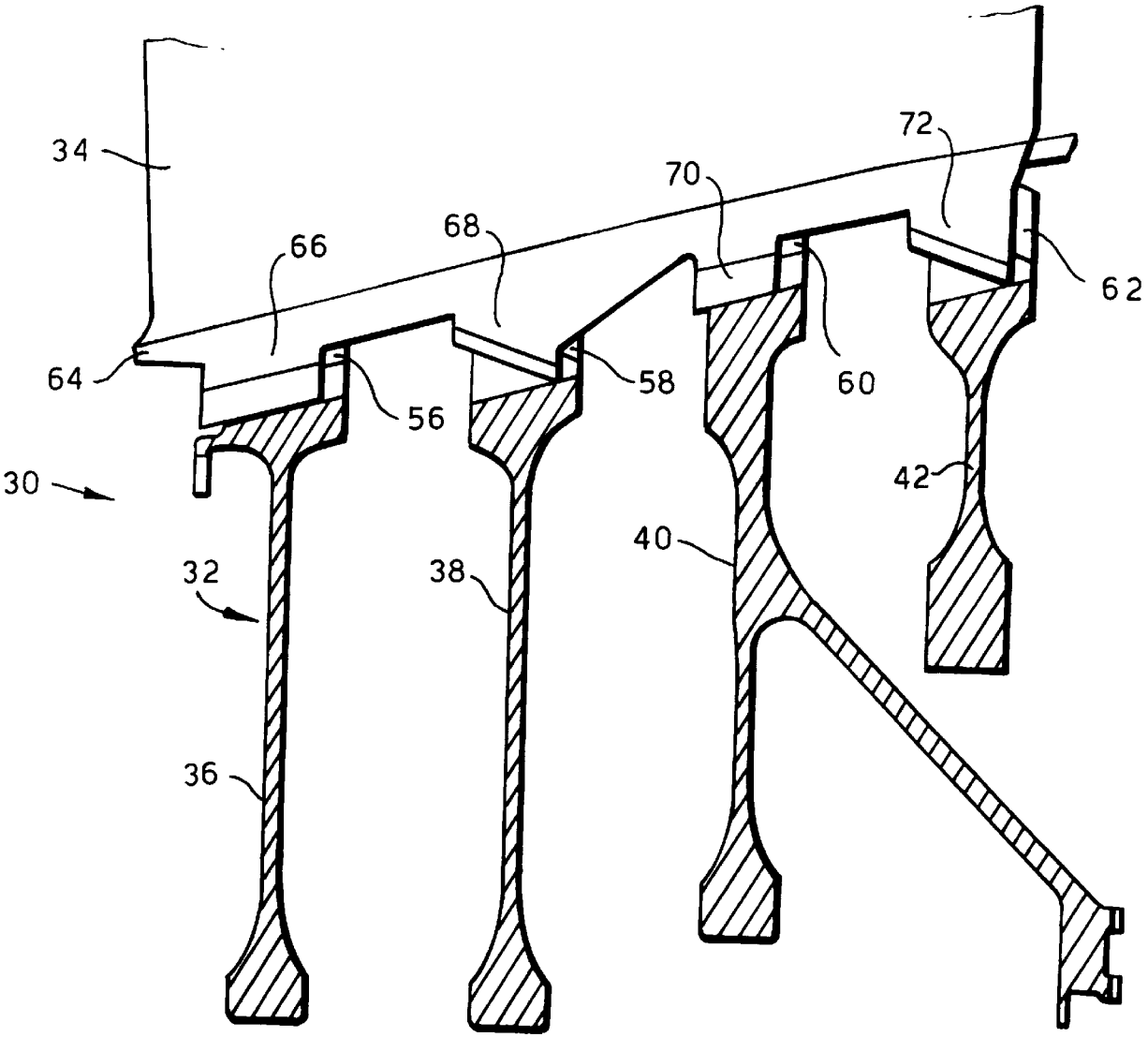
FIG. 6 is a cross-sectional view showing a second stage in the installation of a rotor blade in the rotor to form the rotor assembly shown in FIG. 2.

Each fan blade 34 is loaded onto the fan rotor 32, as shown more clearly in FIGS. 5 and 6, by firstly moving the fan blade 34 radially inwardly into the corresponding groove 54 such that the root portion 66 is located axially upstream of the groove portion 56 of the rotor disc 36, and the root portions 68, 70 and 72 are located axially between the adjacent groove portions 58, 60 and 62 of the rotor discs 38, 40 and 42 respectively. Then secondly the fan blade 34 is moved axially in a downstream direction with a component in a radially outward direction such that the root portions 66, 68, 70 and 72 move axially into the corresponding groove portions 56, 58, 60 and 62 respectively.

The inclined bases 86, 88, 90 and 92 of the groove portions 56, 58, 60 and 62 allow the oppositely inclined flanks 94, 96, 98 and 100 of the root portions 66, 68, 70 and 72 respectively to move axially into the corresponding groove portions 56, 58, 60 and 62.

Each fan blade 34 is unloaded from the fan rotor 32, for replacement or repair, by firstly moving the fan blade 34 axially in an upstream direction with a component in a radially inward direction such that the root portions 66, 68, 70 and 72 move axially out of the corresponding groove portions 56, 58, 60 and 62 respectively. Then secondly the fan blade 34 is moved radially outwardly out of the corresponding groove 54.

The roots 44 of the fan blades 34 are located in the groove 54 of the fan rotor 32 by the design of the four root portions 66, 68, 70 and 72 and the corresponding four groove portions 56, 58, 60 and 62.

In operation, when the fan rotor 32 is rotating, the fan blades 34 generate reaction loads between the flanks 94, 96, 98 and 100 of the root portions 66, 68, 70 and 72 and the flanks 74, 76, 78 and 80 of the groove portions 56, 58, 60 and 62. The eight flanks are arranged to generate equal and opposite forces in all directions, so that there is no resultant force to cause the fan blades 34 to move.

Any forces applied to the fan blades 34 by aerodynamic loading, foreign object impact and fan blade off situations do not displace the fan blades 34 from its assembled position because the fan blades 34 may only be removed by movement in an axial upstream direction with a component in the radially inward direction. The centrifugal force applied to the fan blades 34 during operation is far greater than the resolved radial component of the previously mentioned forces, so that it is very difficult to move the fan blade 34 without failure of the root. It may be possible for the fan blades 34 to move under very large loads, however, the distance moved will be relatively small because the energy of the load is absorbed in movement against the centrifugal force.

The main advantages of the fan rotor assembly is that the use of the two pairs of root portions on the fan blades and two pairs of groove portions on the rotor with oppositely inclined flanks on the root portions and groove portions provides a more positive axial location of the fan blades than that described in European patent application no. EP0821133A. In operation the fan blades are fully located axially, circumferentially and radially by the design of the root portions and groove portions at all engine speeds above about 40 rpm without the requirement for conventional blade locking features. This eliminates the weight and cost of the conventional blade locking features. In operation at speeds below about 40 rpm location of the fan blades is provided by conventional fan blade chocking.

A further advantage of the fan rotor assembly is that the method of assembly allows the volume of space in two of the groove portions 56 and 60 to be reduced by a greater degree than is possible with conventional root and groove arrangements, bringing a further weight reduction.

Another advantage is that the root portions are at increasing radial distances from the axis of rotation, this reduces the weight of the fan blades and brings the additional advantages of reduced fan blade energy if the fan blade should become detached and reduced vibration of the fan rotor if a fan blade should become detached. The reduced fan blade energy if a fan blade becomes detached from the fan rotor, enables the fan blade containment system in the fan casing to be made lighter and cheaper.

The fan rotor may be made from a plurality of forged fan discs, bringing a further reduction in weight and cost.

Another advantage because the root portions are at increasing radial distances from the axis of rotation, is that the groove portions are also at increasing radial distances and this allows the circumferential width of the groove portions and root portions to be increased and the axial length of the groove portions and root portions to be decreased as the radial distance increases.

The axial lengths of the individual root portions need not necessarily be equal and the angles of inclination need not necessarily be the same. The lengths of the individual root portions may be tailored to allow for the position of the forces acting on the fan blades. The lengths and angles of inclination of the flanks are chosen to generate equal and opposite forces in all directions so that there is no resultant force. The angles of inclination of the flanks to the axis are preferably chosen to be the same as the angle of inclination of the inner wall of the flow through the fan section.

Figure 7:
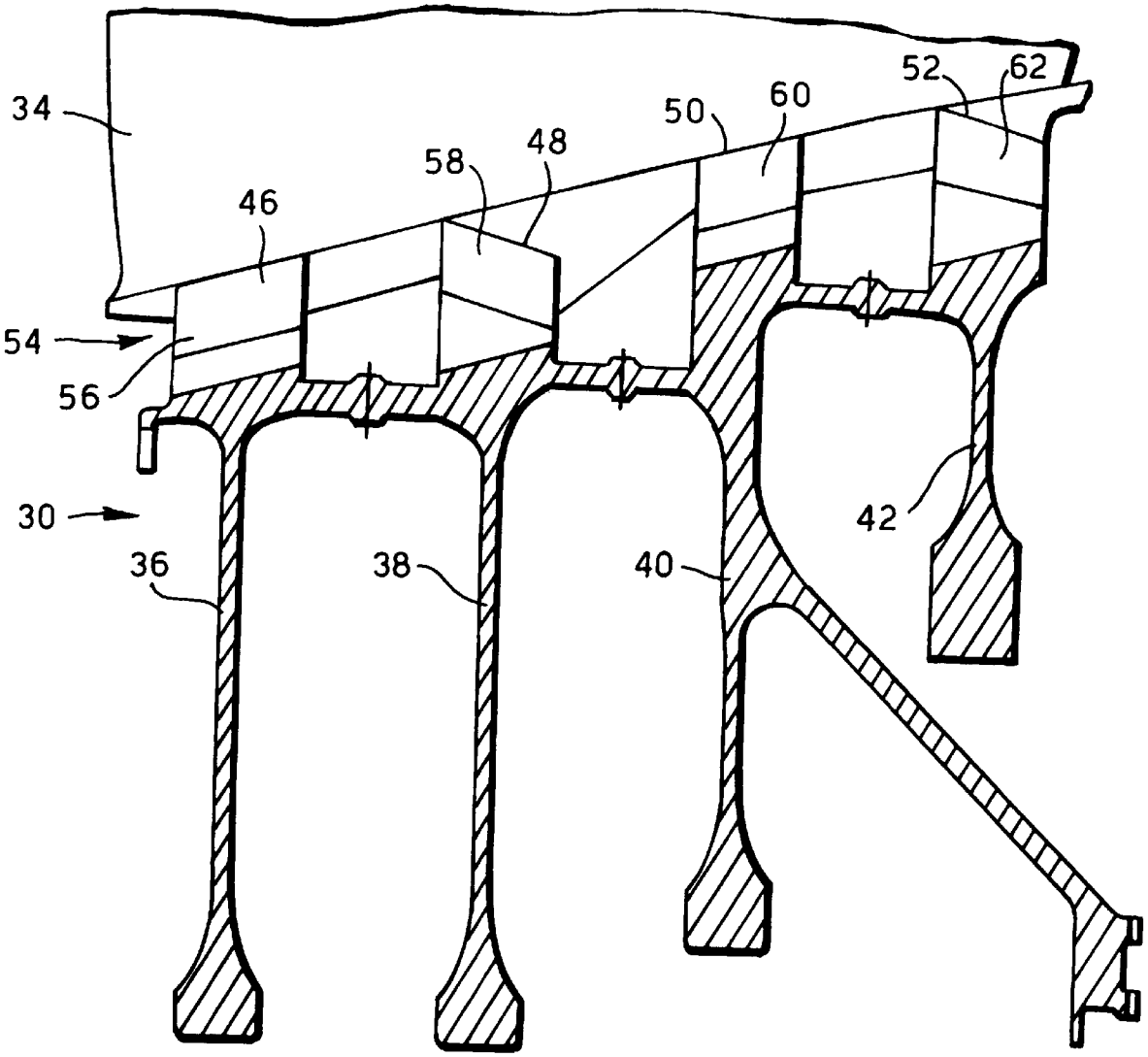
FIG. 7 is an enlarged longitudinal cross-sectional view through an alternative embodiment of the rotor assembly shown in FIG. 1.

Another embodiment of the invention is shown in FIG. 7, which is substantially the same as that shown in FIG. 2 and like numerals denote like parts, but the adjacent rotor discs 36, 38, 40 and 42 are interconnected, by laser or electron beam welded joints, at some radial distance from the hub 44 to form the fan rotor 32.

Figure 8:
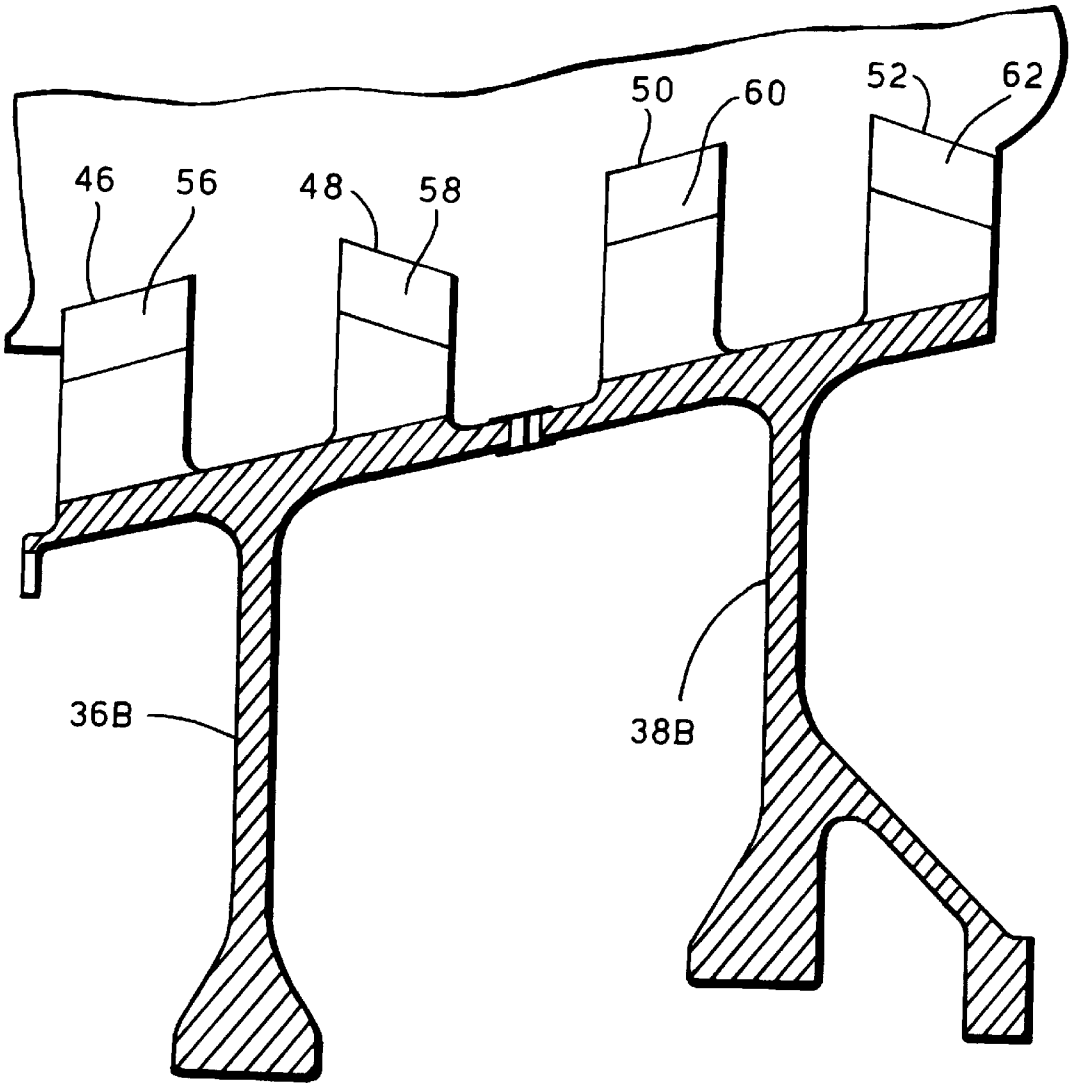
FIG. 8 is an enlarged longitudinal cross-sectional view through another embodiment of the rotor assembly shown in FIG. 1.

A further embodiment of the invention is shown in FIG. 8, which is similar to that shown in FIG. 2 and like numerals denote like parts, but the rotor 32 comprises two rotor discs 36B and 38B, rotor disc 36B has two hubs 46 and 48 which have the groove portions 56 and 58 and rotor disc 38B has two hubs 50 and 52 which have the groove portions 60 and 62.

Figure 9:
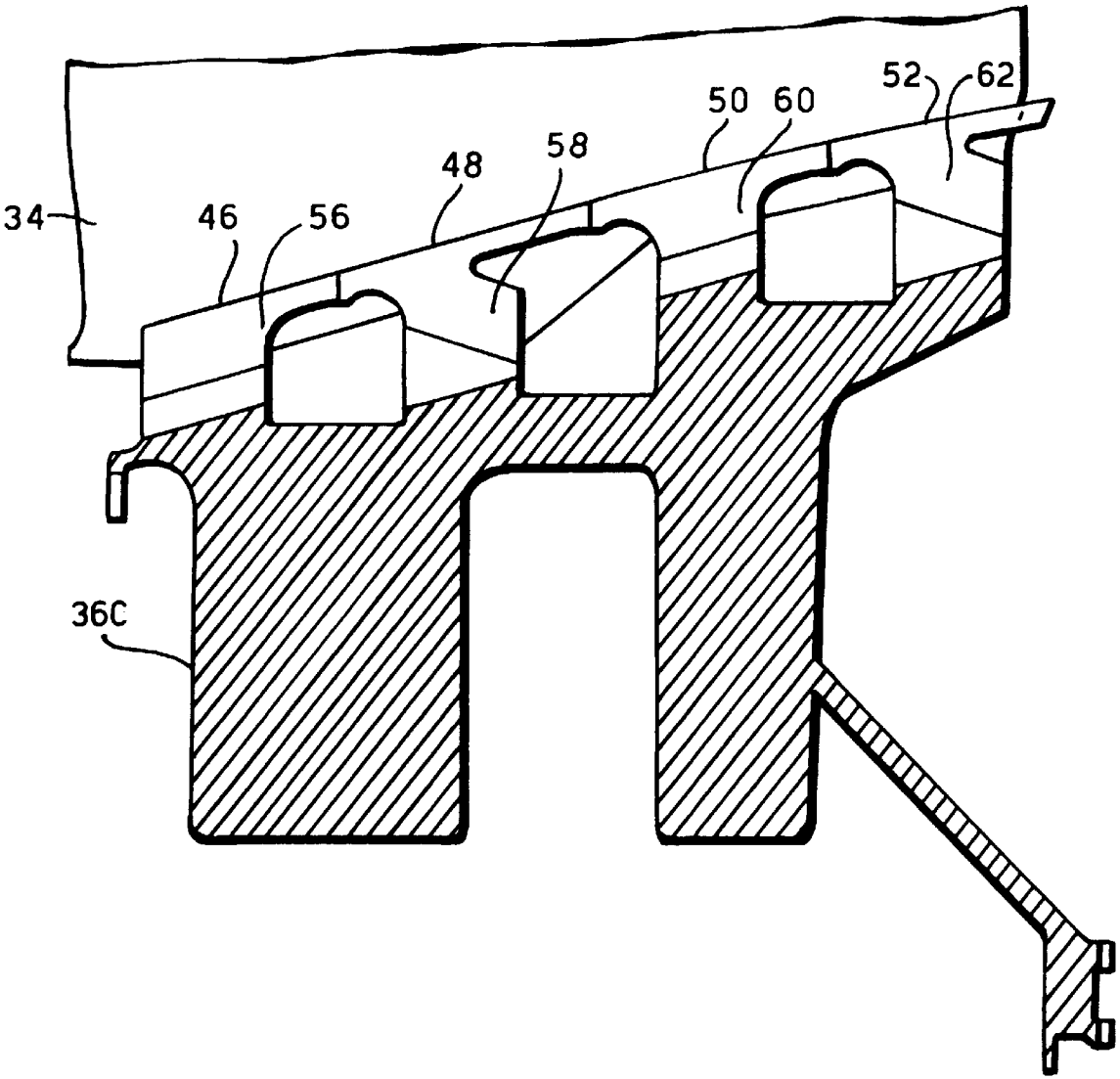
FIG. 9 is an enlarged longitudinal cross-sectional view through a further alternative embodiment of rotor assembly shown in FIG. 1.

A further embodiment of the invention is shown in FIG. 9, which is similar to that shown in FIG. 2 and like numerals denote like parts, but the rotor 32 comprises a single rotor disc 36C, rotor disc 36C has all four hubs 46, 48, 50 and 52 which have the groove portions 56, 58, 60 and 62.

Figure 10:
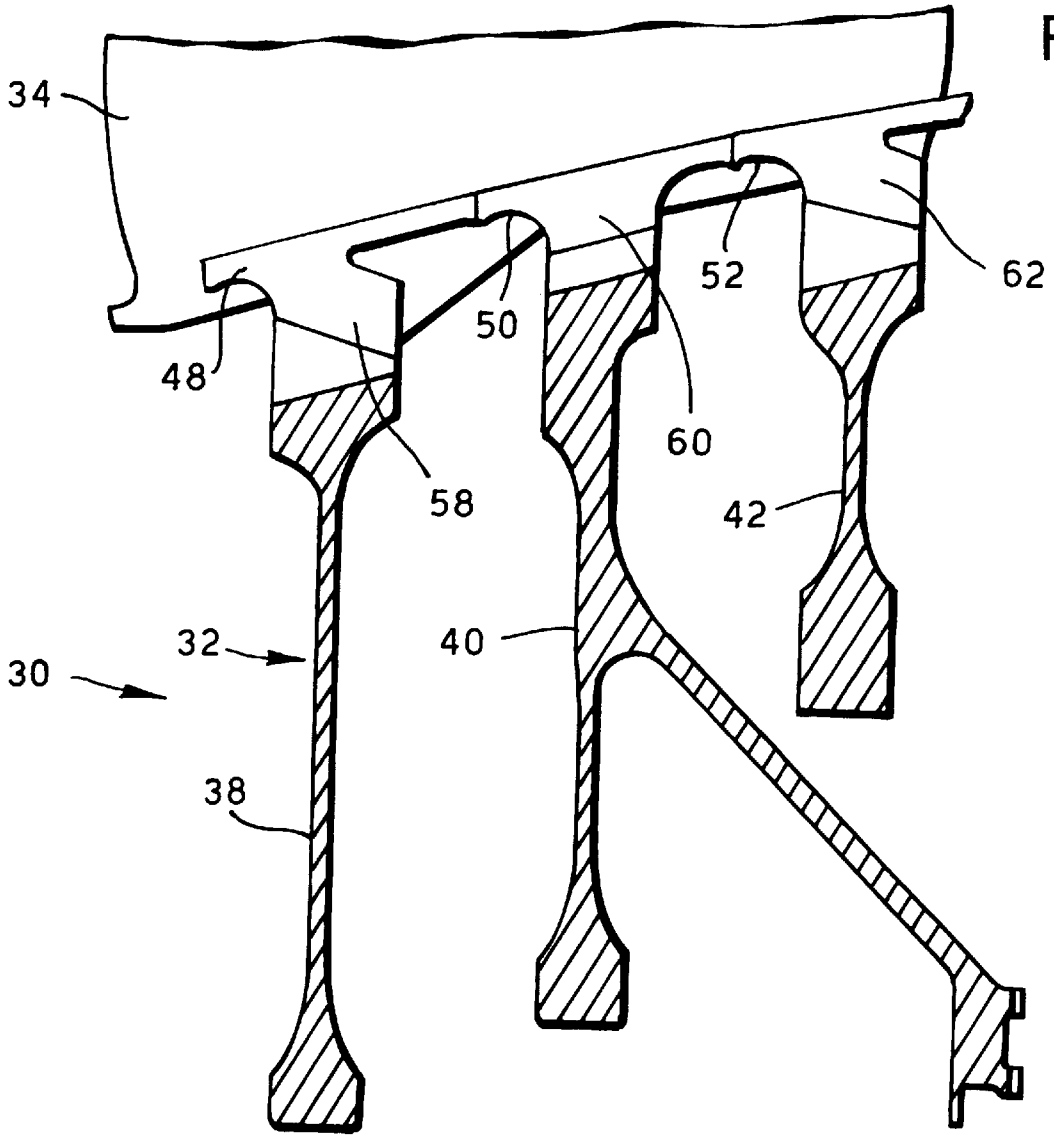
FIG. 10 is an enlarged longitudinal cross-sectional view through a further alternative embodiment of rotor assembly shown in FIG. 1.

A further embodiment of the invention is shown in FIG. 10, which is similar to that shown in FIG. 2 and like numerals denote like parts, but the rotor 32 comprises only three rotor discs 38, 40 and 42 and the rotor discs 38, 40 and 42 have hubs 48, 50 and 52 which have the groove portions 58, 60 and 62. The fan blades 34 have only three root portions 68, 70 and 72.

Figure 11:
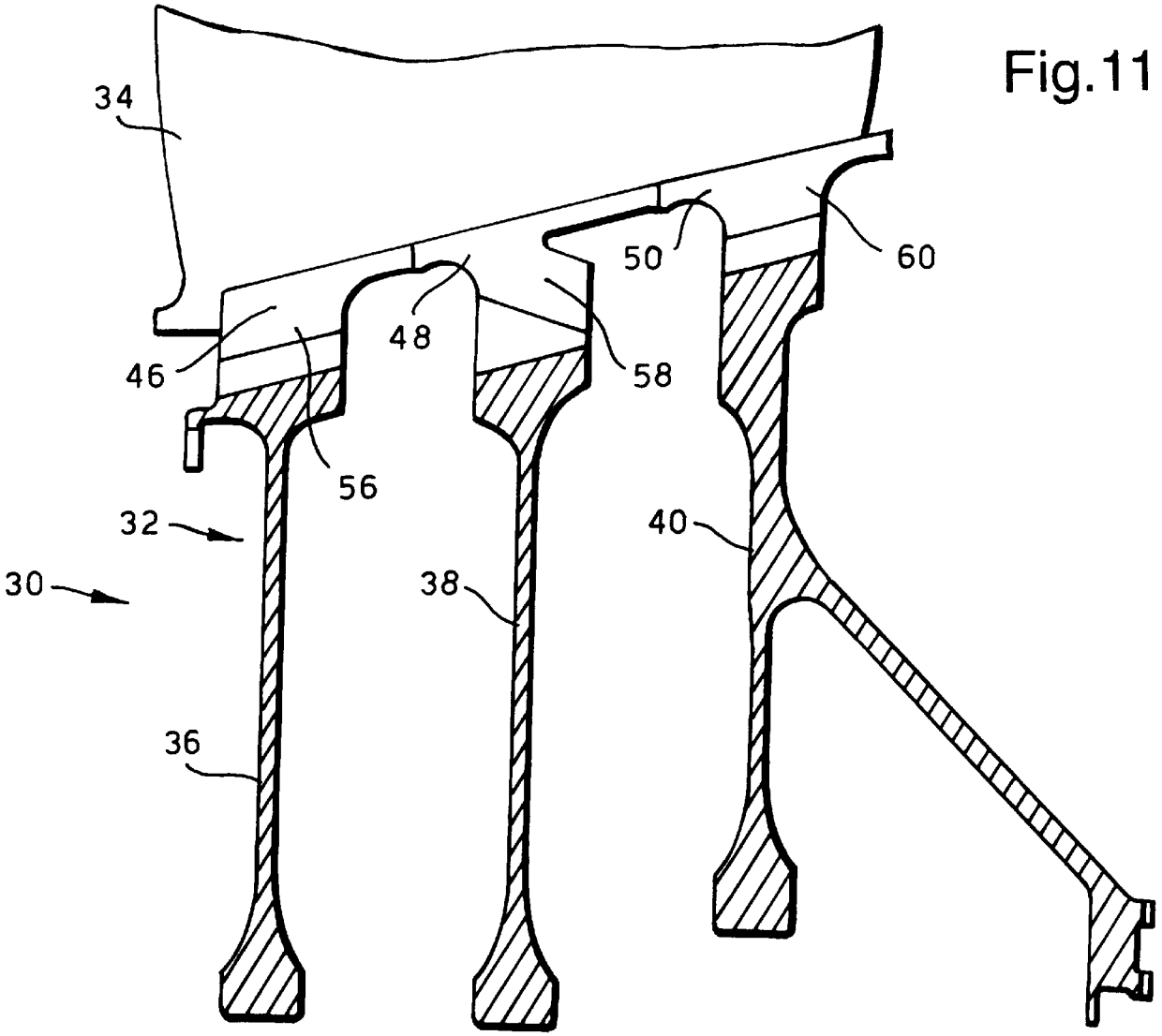
FIG. 11 is an enlarged longitudinal cross-sectional view through a further alternative embodiment of rotor assembly shown in FIG. 1.
Figure 12:
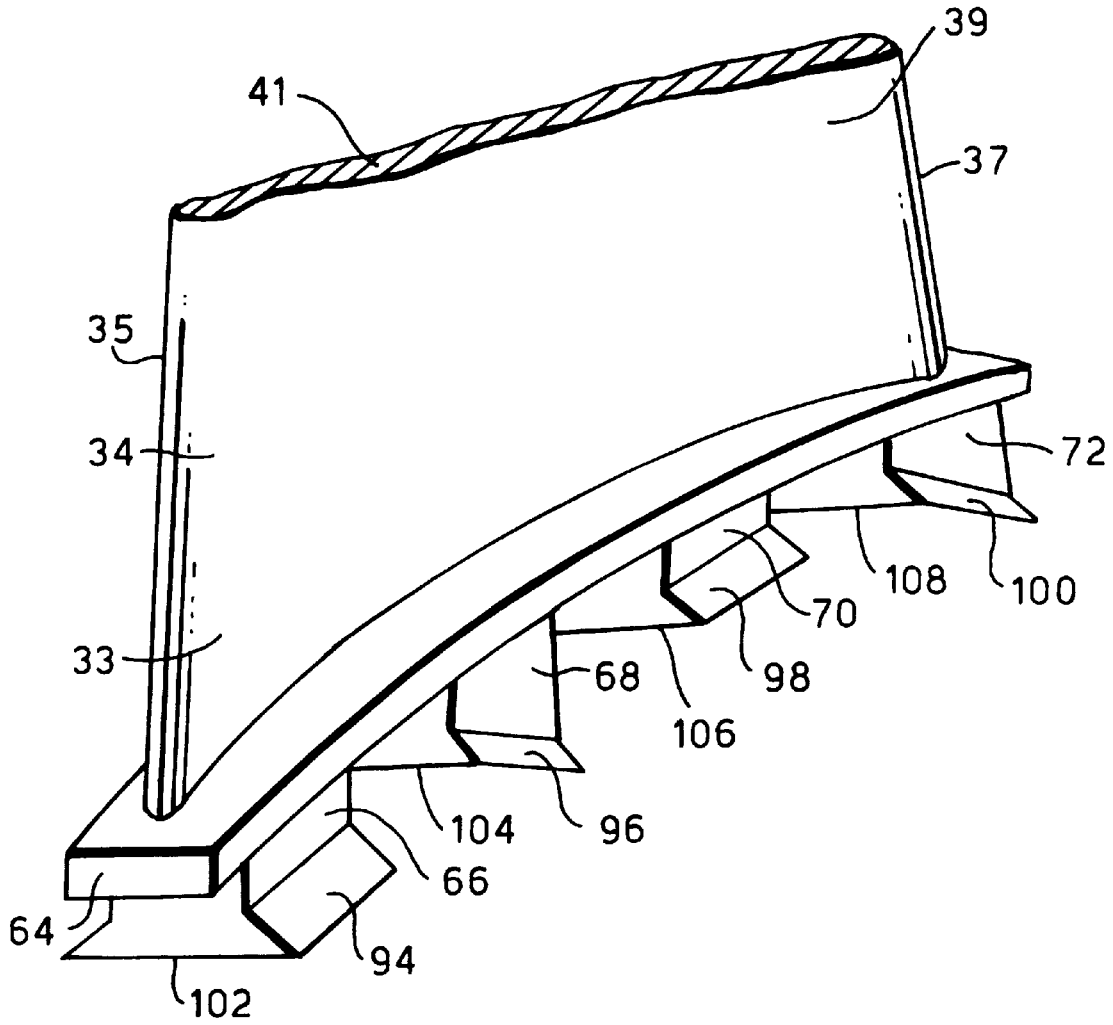
FIG. 12 is a perspective view of the root of the rotor blade shown in FIG. 4.

A further embodiment of the invention is shown in FIG. 11, which is similar to that shown in FIG. 10 and like numerals denote like parts, but the rotor 32 comprises only three rotor discs 36, 38 and 40 and the rotor discs 36, 38, and 40 have hubs 46, 48 and 50 which have the groove portions 56, 58 and 60. The fan blades 34 have only three root portions 66, 68 and 70.

Although the invention has described the root portions 68 and 72 as having bases 104 and 108 inclined in an opposite direction to the bases 102 and 106 of root portions 66 and 70 it may be possible to have them inclined in the same direction, however this has the disadvantage of adding weight to the fan blades 34.

It is seen from FIG. 4 that the flanks 102 and 104 are radially convergent and the flanks 106 and 108 are radially convergent. In addition the bases 102 and 104 are radially convergent and the bases 106 and 108 are radially convergent. It is seen from FIG. 3 that the flanks 74 and 76 of the groove portions 56 and 58 are radially convergent and the flanks 78 and 80 of the groove portions 60 and 62 are radially convergent.

Although the invention has been described with reference to a rotor which has an increase in the hub from the first axial, upstream, end to the second axial, downstream end, it is also possible to use the invention on a rotor which has a uniform radius of the hub from the first axial, upstream, end to the second axial, downstream, end of the rotor with corresponding changes to the fan blades. In this instance the groove portions on the rotor are at substantially the same radial distance from the axis of the rotor and the root portions on the fan blades are at substantially the same radial distance from the axis of the rotor.

The invention is applicable to other rotor assemblies, for example compressor blades and turbine blades or propeller blades. The invention has been described with reference to the use of four root portions and four groove portions, but the invention is applicable to three or more root portions and groove portions. The invention has been described with reference to dovetail cross-section root and groove portions, it is also applicable to other cross-sections of root and groove portions, for example a fir tree cross-section.

It is to be noted that the fan blade root portions, and the rotor groove portions, may be spaced apart purely by an axial component, or they may be spaced apart by axial and circumferential components to define arcuate fan blade roots, or rotor grooves.

We claim:

1. A rotor assembly comprising a rotor having a hub and a plurality of circumferentially spaced radially extending rotor blades, the hub having a plurality of circumferentially spaced axially extending grooves in its periphery, each groove being arranged to receive the root of a corresponding one of the rotor blades, each groove having at least three axially spaced groove portions, each rotor blade having a corresponding number of axially spaced root portions, each groove portion being arranged to receive a corresponding root portion of the corresponding one of the rotor blades, each groove portion having at least two circumferentially extending flanks, each root portion having at least two circumferentially extending flanks, at least the flanks of two of the root portions of each rotor blade being inclined to the axis of the rotor in one sense, at least the flanks of one of the root portions of each rotor blade being inclined to the axis of the rotor in the opposite sense, at least the flanks of two of the groove portions of each groove being inclined to the axis of the rotor in one sense and at least the flanks of one of the groove portions of each groove being inclined to the axis of the rotor in the opposite sense.

2. A rotor assembly as claimed in claim 1 wherein the radius of the hub being smaller at a first axial end of the rotor than at a second axial end of the rotor such that the radii of the bases of the groove portions progressively increase from the first axial end of the rotor to the second axial end of the rotor.

3. A rotor assembly as claimed in claim 1 wherein the bases of the groove portions being inclined to the axis of the rotor such that the radius of the base of each groove portion increases from the first axial end of the groove portion to the second axial end of the groove portion, at least two of the bases of the root portions of each rotor blade being inclined to the axis of the rotor in one sense, at least one of the bases of the root portions of each rotor blade being inclined to the axis of the rotor in the opposite sense.

4. A rotor assembly as claimed in claim 1 wherein each groove has an even number of axially spaced groove portions, each rotor blade has a corresponding number of axially spaced root portions.

5. A rotor assembly as claimed in claim 4 wherein each groove has four axially spaced groove portions, each rotor blade has four axially spaced root portions.

6. A rotor assembly as claimed in claim 4 wherein all the groove portions have equal lengths, half of the number of groove portions are inclined at the same angle in one sense to the axis of the rotor and half of the number of groove portions are inclined at the same angle but in the opposite sense.

7. A rotor assembly as claimed in claim 4 wherein all the groove portions are inclined at an angle between 15° and 18°.

8. A rotor assembly as claimed in claim 7 wherein all the groove portions are inclined at an angle of 16.4°.

9. A rotor assembly as claimed in claim 4 wherein the groove portions have different lengths, half of the number of groove portions are inclined at different angles in one sense to the axis of the rotor and half of the number of groove portions are inclined at different angles but in the opposite sense.

10. A rotor assembly as claimed in claim 1 wherein each of the axially extending groove portions has a dovetail cross-section and each of the root portions has a correspondingly shaped dovetail cross-section.

11. A rotor assembly as claimed in claim 1 wherein the rotor comprises a plurality of axially spaced discs, the hub of each disc having one of the root portions.

12. A rotor assembly as claimed in claim 11 wherein the hubs of adjacent discs are interconnected.

13. A rotor assembly as claimed in claim 12 wherein the hubs of adjacent discs are interconnected by a welded joint.

14. A rotor assembly as claimed in claim 1 wherein the rotor comprises a plurality of axially spaced discs, the hub of each disc having at least two of the root portions.

15. A rotor assembly as claimed in claim 1 wherein the rotor is a fan rotor and the blades are fan blades.

16. A rotor assembly as claimed in any of claim 1 wherein the rotor is a gas turbine rotor and the blades are gas turbine blades.

17. A gas turbine engine comprising a rotor assembly as claimed in claim 1.

18. A rotor blade comprising an aerofoil and a root, the aerofoil having a leading edge, a trailing edge, a convex surface and a concave surface, the leading edge and trailing edge extending in a first direction longitudinally of the rotor blade, the root having at least three root portions spaced apart in a second direction extending between the leading edge and the trailing edge of the aerofoil, each root portion having at least two flanks extending transversely to the first direction and transversely to the second direction, at least the flanks of two of the root portions being inclined to the second direction in one sense, at least the flanks of one of the root portions being inclined to the second direction in the opposite sense.

19. A rotor blade as claimed in claim 18 wherein at least two of the bases of the root portions of the rotor blade being inclined to the first direction in one sense, at least one of the bases of the root portions of the rotor blade being inclined to the first direction in the opposite sense.

20. A rotor blade as claimed in claim 18 wherein there are an even number of axially spaced root portions.

21. A rotor blade as claimed in claim 20 wherein there are four axially spaced root portions.

22. A rotor blade as claimed in claim 21 wherein the rotor blade is a fan blade.

23. A rotor having a hub, the hub having a plurality of circumferentially spaced axially extending grooves in its periphery, each groove having at least three axially spaced groove portions, each groove portion having at least two circumferentially extending flanks, at least the flanks of two of the groove portions of each groove being inclined to the axis of the rotor in one sense and at least the flanks of one of the groove portions of each groove being inclined to the axis of the rotor in the opposite sense.

24. A rotor as claimed in claim 23 wherein the radius of the hub being greater at a first axial end of the rotor than at a second axial end of the rotor such that the radii of the bases of the groove portions progressively increase from the second axial end of the rotor to the first axial end of the rotor.

25. A rotor as claimed in claim 23 wherein the bases of the groove portions being inclined to the axis of the rotor such that the radius of the base of each groove portion increases from the second axial end of the groove portion to the first axial end of the groove portion.

26. A rotor as claimed in claim 23 wherein each groove has an even number of axially spaced groove portions.

27. A rotor as claimed in claim 26 wherein each groove has four axially spaced groove portions.

28. A rotor as claimed in claim 26 wherein all the groove portions have equal lengths, half of the number of groove portions are inclined at the same angle in one sense to the axis of the rotor and half of the number of groove portions are inclined at the same angle but in the opposite sense.

29. A rotor as claimed in claim 26 wherein all the groove portions are inclined at an angle between 15° and 18°.

30. A rotor as claimed in claim 29 wherein all the groove portions are inclined at an angle of 16.4°.

31. A rotor as claimed in claim 23 wherein each of the axially extending groove portions has a dovetail cross-section.

32. A rotor as claimed in claim 23 wherein the rotor comprises a plurality of axially spaced discs, the hub of each disc having one of the groove portions.

33. A rotor as claimed in claim 32 wherein the hubs of adjacent discs are interconnected.

34. A rotor as claimed in claim 33 wherein the hubs of adjacent discs are interconnected by a welded joint.

35. A rotor as claimed in claim 23 wherein the rotor comprises a plurality of axially spaced discs, the hub of each disc having at least two of the root portions.

* * * * *